United States Patent [19]

McNab et al.

[11] Patent Number: 4,968,103

[45] **Date of Patent: * Nov. 6, 1990**

[54] METHOD OF MAKING A BRUSH

[75] Inventors: Donald McNab, Long Beach; Edward Moya, San Gabriel; Hector Stickar, Walnut, all of Calif.

[73] Assignee: Photofinish Cosmetics Inc., Encino, Calif.

[ * ] Notice: The portion of the term of this patent subsequent to Mar. 13, 2090 has been disclaimed.

[21] Appl. No.: 400,983

[22] Filed: Aug. 31, 1989

Related U.S. Application Data

[63] Continuation of Ser. No. 222,808, Jul. 22, 1988, Pat. No. 4,908,902.

[51] Int. Cl.[5] ..... A46D 3/00

[52] U.S. Cl. ..... 300/21

[58] Field of Search ..... 300/21, 2-11; 264/243; 15/159 R

[56] References Cited

U.S. PATENT DOCUMENTS 4,795,218 1/1989 Seidler ..... 300/21

*Primary Examiner*—Mark Rosenbaum

*Attorney, Agent, or Firm*—Cohen, Pontani & Lieberman

[57] ABSTRACT

A brush adapted for selective application of a flowable fluid to a workpiece is formed in its entirety of a heat fusible synthetic material and includes a hollow head section, a plurality of bristles depending from the head section, and a fluid distribution channel defined by a flexible membrane and extending substantially axially within the radial interior of the bristles from the head section of the brush toward the free ends of the bristles. Fluid fed to the brush head is delivered through the head section to the distribution channel and is discharged from the channel onto the bristles within the interior of the bristle tuft and proximate the bristle ends for facilitated distribution among the bristles and ready application to a workpiece by the user.

14 Claims, 3 Drawing Sheets

FIG. 1
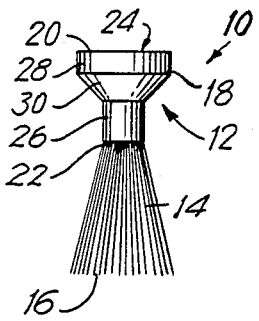
FIG. 2
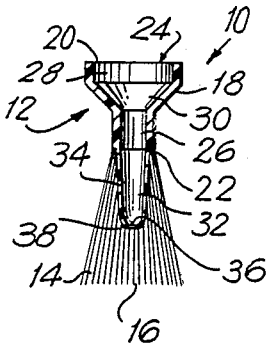
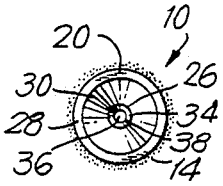
FIG. 3
FIG. 5
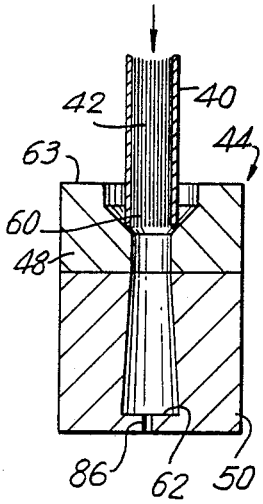
FIG. 4B
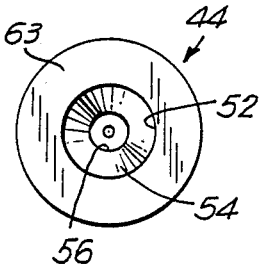
FIG. 4A
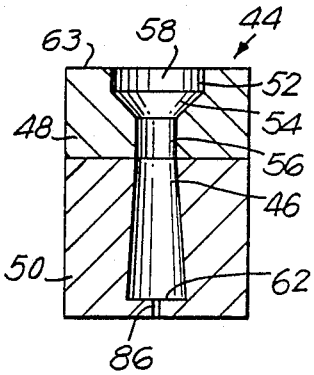

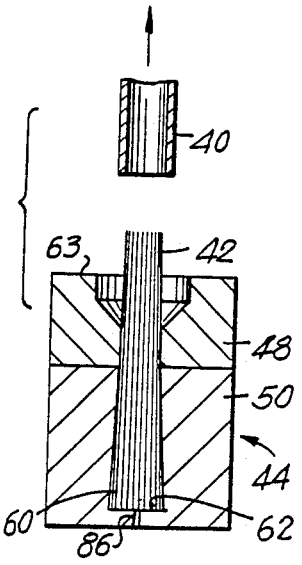
FIG. 6
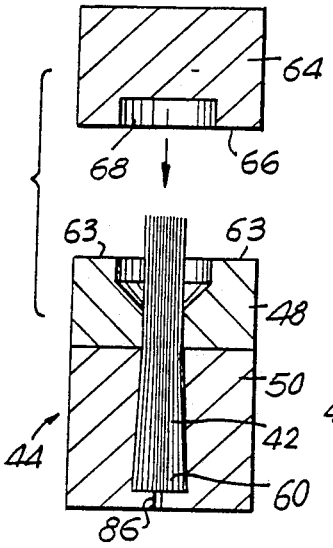
FIG. 7
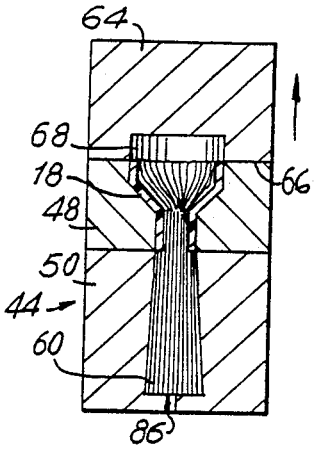
FIG. 8
FIG. 10
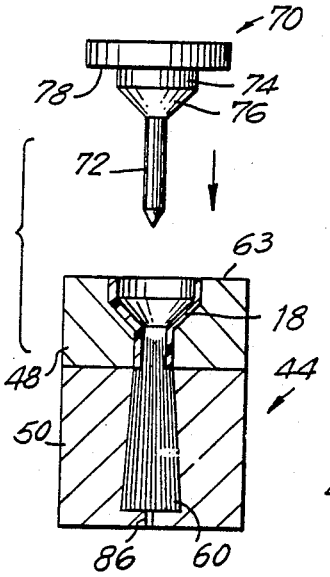
FIG. 9
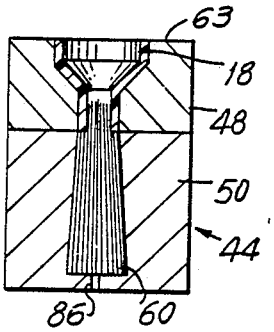
FIG. 11
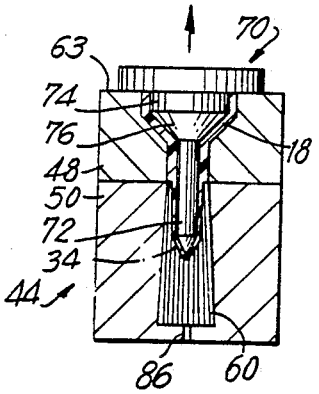

METHOD OF MAKING A BRUSH

This is a continuation of application Ser. No. 222,808, filed July 22, 1988, now U.S. Pat. No. 4,908,902.

Background of the Invention

The present invention generally relates to an improved brush and to a method of making such a brush. The invention is more particularly directed to a brush, and to a method of its fabrication, which is adapted for selectively applying a flowable fluid to a workpiece.

Objects of the Invention

It is the desideratum of the present invention to provide a brush adapted for use in applying a flowable fluid to a workpiece wherein the brush bristles receive the fluid to be applied in a manner which assures appropriate distribution of the fluid throughout the bristles for facilitated application to the workpiece.

It is a particular object of the invention to provide such a brush wherein the fluid is distributed to the bristles from an interior part of the bristle tuft.

It is another object of the invention to provide such a brush wherein distribution of the fluid to an interior part of the bristle tuft is accomplished without risk of damage to the workpiece surface in applying the fluid.

It is a further object of the invention to provide such a brush which is fabricated in its entirety of a single material of construction.

It is still another object of the invention to provide a method of making such a brush with a degree of precision that assures consistency of all brushes produced in accordance with the method.

Yet another object of the invention is to provide a method of making a brush that is unusually economical and enables the brush to be manufactured utilizing well-known techniques.

Further objects, features and advantages of the present invention will be more fully appreciated by reference to the following detailed description of presently preferred, but nonetheless illustrative, embodiments in accordance with the present invention when taken in conjunction with the accompanying drawing.

Brief Description of the Drawing

In the drawing, wherein similar reference numerals denote similar elements throughout the several views:

FIG. 1 is an elevated side view of a preferred embodiment of an improved brush adapted for selective application of a flowable fluid to a workpiece in accordance with the present invention;

FIG. 2 is a sectional side view of the improved brush of FIG. 1;

FIG. 3 is a top plan view of the improved brush of FIGS. 1 and 2;

FIGS. 4A and 4B are sectional side and top plan views, respectively, of a mold for use in fabricating an improved brush in accordance with a preferred method of the invention; and FIGS. 5 to 17 serially depict the various steps in the preferred method of fabricating an improved brush in accordance with the invention.

Detailed Description of the Preferred Embodiments

Figure 12:
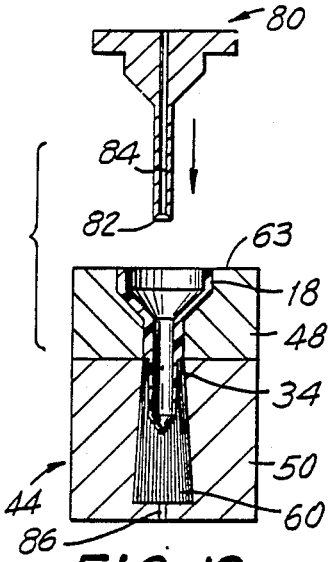

The present invention is directed to an improved brush which is adapted for use in selectively applying a flowable fluid to a workpiece, and to a method of making the brush. The improved brush has particular utility when disposed on or in association with a dispenser or the like containing a supply of flowable fluid and constructed to enable ready discharge and selected application of the fluid to an intended surface or the like. Thus, the inventive brush may, by way of example only, be advantageously employed for applying cosmetic fluids, such as nail polish or mascara, to appropriate areas on a user's body, for which purpose it is generally contemplated that the brush be mounted at the discharge end of a typically hand-held and user-manipulatable fluid containing dispenser. Nevertheless, numerous other uses of the inventive brush are also contemplated and no limitation to any particular disclosed or suggested application is intended.

A currently preferred embodiment of the improved brush, designated by the general reference numeral 10, is illustrated in FIGS. 1 to 3. Although the brush is preferably constructed in its entirety of a single material so as to form a unitary structure, those skilled in the art will recognize and appreciate that other arrangements and constructions and modifications by which the brush 10 is fabricated, for example of discrete parts or elements variously formed of the same or of different materials, are within the scope of the invention. As will become apparent as this description proceeds, the within disclosed method of making the brush 10 contemplates its preferred fabrication from a heat fusible synthetic material such, for example, as a polymer such as nylon or polyethylene or the like.

Referring now specifically to FIGS. 1 to 3, brush 10 includes a head section 12 and a plurality of elongated fibers or filaments or bristles 14 extending axially outwardly from the head section to their free and relatively-moveable distal ends 16. The fibers 14 form a tuft of generally but not necessarily circular cross-section which, in the illustrated form of the brush 10, is radially outwardly flared from the brush axis at the distal or workpiece-engaging end of the tuft. The presence or lack of radially outward flaring at the tuft distal end, and the amount of any such flaring, is a matter of design choice which may be determined at least in part by the particular application contemplated or intended for the brush.

Head section 12 is defined by a peripheral wall 18 that extends from a rim 20 to its juncture with the root or proximal ends 22 of fibers 14. Wall 18 is depicted as having a substantially circular cross-section but may of course have many alternate shapes. Rim 20 defines an opening 24 into the substantially hollow interior of head section 12 through which fluid fed into opening 24 is delivered to fibers 14 for selected application to a workpiece. That hollow interior of the head section is peripherally bounded by wall 18 which, in the preferred form of brush 10, is formed of the same material as the fibers 14. Where this material is, for example, a heat fusible synthetic polymer, as is currently preferred, wall 18 may be conveniently and advantageously fabricated by heat-induced fusing of the proximal ends of the elongated fibers 14 whereby the wall and head section 12 are integrally formed on and unitrarily bonded to the fibers. This method of fabrication is fully disclosed and described herein. Thus, the root or proximal ends 22 of the fibers supportedly depend—preferably unitarily and integrally depend—and extend outwardly from the neck 26 of head section 12.

In the illustrated embodiment of the improved brush 10 of the invention, head section 12 is unitarily formed of three readily discernable sections. Rim 20 defines the upper edge of a mounting skirt 28 which is unitarily connected to neck 26 by an intermediate portion or section 30. Intermediate section 30 has a radially inward taper as it extends from the relatively larger diameter periphery of skirt 28 to the cross-sectionally smaller neck 26. Skirt 28 and neck 26 may each, as illustrated, have a substantially constant diameter or, alternatively, one or both may selectively inwardly taper as they extend in the direction of fibers 14. Indeed, even where the exterior diameter of skirt 28 is substantially constant along its axial extent, the provision of a predetermined taper on at least a portion of the interior periphery of wall 18 at skirt 28 may facilitate mounting of the brush 10 on the fluid discharge end of a particular operatively associated dispenser (not shown). Moreover, although it is generally contemplated that wall 18, howsoever formed, be substantially rigid so as to facilitate mounted retention of the brush on a fluid-containing dispenser or other article, wall 18 (or a part or parts thereof) may also be provided with a predetermined flexibility or plasticity for use in a particular application. In the disclosed embodiment of brush 10, for example, wall 18 has a substantial thickness for providing a desired degree of rigidity, and the thickness of wall 18, or of a part or parts thereof, may be varied to provide a predetermined rigidity or flexibility for a particular use of the brush. All such modifications are within the scope and contemplation of the invention.

Brush 10 further includes a fluid distribution channel 32 which extends axially from the terminating end of head section neck 26 toward the distal ends 16 of the fibers 14. Channel 32 is defined by an annular membrane 34 that depends from and forms an extension of wall 18 and is preferably fabricated so as to render membrane 34 flexible—and most preferably resiliently flexible. Such flexibility prevents inadvertent damage to the workpiece, as for example scratching or chaffing of the skin of a user, should the brush be pressed with undue force against the surface to which an application of fluid is intended. Where, as herein disclosed, brush 10 is unitarily formed in its entirety of the same material—such as a heat-fusible synthetic—the preferred flexibility of membrane 34 may be provided by significantly limiting its thickness, particularly with respect to the substantial thickness of the peripheral wall 18 by which wall 18 is rendered relatively rigid.

Membrane 34 serves as the peripheral boundary of the distribution channel 32 along which fluid is fed or directed from the brush head section 12 into the interior of the tuft of fibers 14 for selective, typically user-manipulated application to the workpiece. For this purpose channel 32 is provided with a discharge outlet or opening 36 at its discharge or free end 38. The size of the opening 36 may be selected in accordance with the flow characteristics of the fluid and the desired volumetric rate of fluid application to the workpiece. Thus, some fluids and/or applications may dictate or suggest that the opening 36 be unusually small so that, in order to discharge fluid onto the brush fibers for application to a workpiece, the fibers must be pressed against the workpiece with sufficient force to deform the distribution channel membrane 34 and thereby force or otherwise facilitate the flow of fluid through the opening. In other cases, a relatively larger opening 36 permitting ready and substantially unimpeded flow of fluid discharged from an attached or associated dispenser onto the brush fibers 14 may be provided. The size of the opening 36, therefore, is a matter of design choice.

Since it is generally intended that fluid be delivered from distribution channel 32 onto the fibers 14 at a location within the tuft suitable for enabling appropriate distribution of the fluid amongst the plural, relatively moveable fibers and thereby facilitating user-controllable application of the fluid to the workpiece, the particular point along the axial extension of the fibers at which fluid is discharged onto the fibers from distribution channel 32 may be varied as a matter of design choice with attention to the characteristics of the fluid to be dispensed, the manner of its intended application to the workpiece, and any pertinent aspects of the workpiece. It should in any event be clearly understood that, in accordance with the invention, membrane 34 extends preferably substantially axially from neck 26 toward the distal ends 16 of the fibers and terminates at its free end 38 proximate but short of the fiber ends. Proximate, as thus used in this disclosure and in the appended claims, is accordingly intended to broadly cover a wide range of axial extensions of fluid distribution channel 32 and of membrane 34 from the head section neck 26 toward the free ends 16 of the brush fibers.

The membrane-bounded distribution channel 32 may, as illustrated, have a gentle or moderate inward taper or slope as it extends axially toward the fiber ends 16. The rate of inward taper may be substantially constant or may, alternatively, vary along the axial extension of channel 32. It is, however, generally anticipated that to the extent that opening 36 has a diameter less than the peripheral diameter of the membrane substantially adjacent the channel's free end 38, the free end 38 will have a relatively sharp inward taper so as to facilitate discharge of the fluid from channel 32 onto fibers 14 through opening 36. Configurations in which the channel free end 38 lacks a sharp inward taper are, nevertheless, contemplated.

Also contemplated are modifications of distribution channel 32 having substantially no inward taper, or having axially-extending sections or areas having substantially no inward taper. Here again, however, it is anticipated that such modified constructions may have a relatively sharp inward taper at or adjacent the free end 38 of membrane 34. In a modified embodiment (not shown) of the brush having a substantially untapered membrane 34 from its juncture with neck 26 to at least proximate discharge opening 36, the membrane may be integrally joined to or otherwise depend from the interior periphery of neck 6 so as to provide a diameter sufficiently smaller than that of neck 26 to enable ready disposition of channel 32 fully within the radial interior of fibers 14.

In use, fluid fed to brush 10 from an associated dispenser or other fluid source enters the brush at opening 24 and is directed along head section 12 through its hollow interior. From head section 12, the fluid enters and flows through distribution channel 32 from which it is discharged onto the fibers 1 through outlet 36. The placement of outlet 36 within the radial interior of the fiber tuft and in predetermined spaced relation with the fiber free ends 16 is such that the discharged fluid is distributed throughout the fibers, particularly at or proximate their free ends 16, to an extent commensurate with the particular intended use of the brush 10. Where, for example, the fluid is a nail polish or enamel intended for broad application to a user's nails, a relatively wide dispersion of the fluid among the brush fibers is desireable. A fluid such as mascara, on the other hand, intended for application to a selectively limited area or surface region may more appropriately require very limited dispersion of the fluid among the brush fibers after delivery to the fibers from within distribution channel 32.

A currently preferred method for making a brush 10 in accordance with the invention will now be described with particular reference to FIGS. 4 to 17. In this preferred but nonetheless illustrative method the brush is fabricated in its entirety from a plurality of elongated fibers or filaments formed of a synthetic heat-fusable material so that the entire resulting brush is unitarily constructed of the same synthetic material such, for example, as a polymer such as nylon or polyester. The fibers are initially assembled into a tuft of said fibers and then placed into a holder in which the fibers are retained during the remainder of the brush-fabricating process. Typically, as is known in the art, a multiplicity of such fibers are arranged in parallel relationship in a puck or other supply container from which a desired quantity and/or density of fibers is picked to form a tuft of desired cross-sectional shape. Thus, in accordance with the method of the invention a pick-up tube 40 (FIG. 5) is inserted into a puck (not shown) or the like containing a multiplicity of parallel synthetic fibers and, when the pick-up tube is subsequently withdrawn from the puck, it contains a plurality of the fibers defining a fiber tuft or bundle 42. The fibers contained in the puck and picked by reciprocated insertion and withdrawal of tube 40 may be cut-to-length before picking, as is preferred, or may be cut down to appropriate length subsequent to the fiber picking operation. In any event, it is intended that all of the plural fibers forming the tuft 42 be of substantially the same length at least prior to the first fusing of the fibers as hereinafter described.

A suitable holder into which the tuft 42 of fibers may be received for further processing in the fabrication of the brush 10 is illustrated, by way of example, in FIGS. 4A and 4B. This tuft holder or mold 44 includes a cavity 46 extending into the interior of the mold for receiving and retaining the tuft of fibers during the brush-fabricating process. Cavity 46 is specially configured in accordance with the intended final configuration of the brush as will hereinafter become clear.

Mold 44 comprises a mold head or die 48 formed of a readily heat-conducting and retaining material and disposed at that portion of the mold which carries the open end of tuft-receiving cavity 46. Mold head 48 peripherally bounds cavity 46 throughout the entire axial extent of the head section 12 to be formed on the completed brush 10 in the practice of the method of the invention. The remainder or lower-disposed (in FIG. 4A) base section 50 of mold 44—i.e. that portion peripherally bounding the relatively freely movable fibers 14 in the completed brush 10—is formed of a material that neither retains nor absorbs heat. A presently contemplated material for this base section 50 of the mold is asbestos, although numerous alternate materials—such, for example, as various nonferrous materials—may be utilized.

The upper (in the Figures) portion of tuft-receiving cavity 46—that portion bounded by mold head 48—has the same peripheral shape as the intended final exterior configuration of the completed brush head section 12. Thus, this upper portion of cavity 46 includes respective wall sections 52, 54, 56 diametrically corresponding to the mounting skirt 28, the intermediate portion 30 and the neck 26 of head section 12 of the brush 10. This correspondence is a result of the fact that, as is hereinafter described, the peripheral wall 18 of head section 12 is formed along the internal peripheral wall sections 52, 54, 56 of cavity 46 in mold head 48 which, accordingly, determine the final exterior shape of the brush head section 12. Other configurations of the peripheral wall of mold head 48 are, of course, within the scope and contemplation of the invention.

After having been picked from the puck or other supply of fibers by tube 40, the fiber tuft 42 is inserted into mold cavity 46 through the cavity open end 58. The transfer of the tuft from a pick-up tube to a receiver—such as the mold 44 of the invention—may be effected in any conventional or otherwise appropriate manner such, for example, as by driving the tuft from the tube by operation of a reciprocatable piston or using compressed or with a pressurized gaseous fluid such as air or the like. In any event, pick-up tube 40 is moved into suitable abutment or proximity with mold head 48 and the tuft 42 of fibers is driven into cavity 46 until the distal ends 60 of the fibers and tuft substantially abut the cavity bottom 62. The pick-up tube is then retracted (FIG. 6) from the mold. As illustrated in FIGS. 6 and 7, the cut-to-length elongated fibers are preferably sized so as to initially protrude beyond the top surface 63 of the mold at the cavity open end 58 by an amount selected to provide a sufficient volume of the synthetic material of the fibers for forming the preferably relatively thick peripheral wall 18 of the completed brush 10.

It is also contemplated that, in an alternate embodiment of the method and apparatus of the invention, the free or bottom or work end of the brush 10 be provided with a contour—other than that illustrated in the drawing—defined by fiber ends 16 of variously graduated or otherwise different lengths. For this purpose, the cavity bottom 62 of mold 44 may have a contour (not shown) corresponding to the desired final contour of the brush end, so that as the fiber tuft 42 is ejected or driven from pick-up tube 40 into mold cavity 46 the respective fiber ends 16 move into abutment with the corresponding portions of contoured cavity bottom 62. Following receipt of the fiber tuft fully within the mold cavity, such that the fiber ends 16 abut the contoured surface 62, the opposite ends of the fibers may be variously trimmed to length, as may be necessary, prior to the ensuing heat fusing step of the inventive method. The mold 44 may additionally, both in the preferred method of the invention herein described and illustrated and in this modification for providing a selectively contoured brush end, be vibrated or otherwise subjected to movement sufficient to facilitate downward movement of all of the fiber ends 16 into abutment with the cavity bottom 62.

A heater block 64, which is maintained during the entire period of its reciprocation at a temperature sufficient to effect substantially immediate fusing of the synthetic material of the fibers, is then moved into heat transfer relation with the mold head 48. Where the synthetic material is nylon, block 64 may be maintained at a temperature of approximately 600° F. which is suitably above the melting point of the material. As seen in FIGS. 7 and 8, block 64 has a contact face 66 arranged in the embodiment herein disclosed for reciprocated abutment with the surface 63 of mold 44 and, in addition, a recess 68 aligned with and substantially corresponding in cross-sectional size to that of the wall section 52 of cavity 46. Thus, when the heated block 64 is placed in surface-to-surface abutment with the head 48 of mold 44, there is a transfer of heat from block 64 to mold head 48 and the temperature within the confined space bounded by block recess 68 and the upper portion of cavity 46 at head 48 is raised to a point sufficient to cause melting of the fibers contained therewithin. This heat transfer abutment of the block 64 and mold head 48 is maintained for a period—approximately 5 to 10 seconds where the synthetic material is nylon and the temperature of block 64 is maintained at approximately 600° F.—selected so that, when the heated block is subsequently retracted (FIG. 9), the synthetic material within the mold head 48 has fused and formed along the interior peripheral wall sections 52, 54, 56 the relatively thick wall 18 of the brush. The lower portions of the fibers, on the other hand, by reason of their containment within that portion of the cavity 46 bounded by base 50, remain unfused and thus retain their original elongated filamentary form. These unfused and relatively movable fibers are, however, unitarily connected at and depend from the fused synthetic material within the mold head 48, which fused material defines the wall 18 and has been formed from the original proximal ends of the fibers.

The membrane 34 of the fluid distribution channel 32 of the brush is next formed by inserting a heated pin 70 into mold cavity 46 through its open end 58. Pin 70 is constructed of a suitably high heat-conductive material such, by way of example, as copper or bronze. Referring to FIG. 10, pin 70 includes an elongated rod or shaft 72 along which the distribution channel membrane 34 is formed and which is carried on a base 74 and a step 76. The radial peripheries of base 74 and step 76 conform to the intended final configurations of the interior faces of the brush wall 18 at the skirt 28 and intermediate portion 30, respectively, and are cross-sectionally sized smaller than the cross-sectional sizes of the respective peripheral wall sections 52, 54 by an amount corresponding to the intended final thickness of the peripheral brush wall 18 at skirt 28 and intermediate portion 30. Thus, when heated pin 70 is inserted into mold cavity 46 (FIGS. 10 and 11) the base 74 and step 76 provide, to the extent necessary, final shaping of the skirt and intermediate portions 28, 30 of the brush head section 12.

The upper portion of shaft 72—i.e. that portion immediately adjacent step 76—has the cross-sectional shape and size of the interior face of brush wall 18 at neck 26. The remainder of shaft 72 substantially corresponds in shape and size to the intended final configuration of channel 32. In the form of the brush 10 illustrated in FIGS. 1 to 3 and to which the herein-described method of fabrication is directed, channel 32 has only a relatively gentle or moderate inward taper along its length—with the possible exception of a relatively sharp taper that may be provided immediately adjacent discharge opening 36 where the opening 36 has a diameter substantially smaller than the diameter of the membrane at its free end. Of course, a variety of tapers may be applied, in accordance with the invention, to the channel 32 by appropriate modification of the configuration of shaft 72, and a channel 32 having substantially no inward taper along its length except, perhaps, immediately adjacent discharge opening 36 is also contemplated. It is, in any event, important where a one-piece mold of the type disclosed is employed that the cross-sectional size of the exterior periphery of channel 32 at its juncture with brush neck 26 be no larger than the exterior periphery of neck 26 so as to permit ready removal of the completed brush 10 from the mold (FIGS. 16 and 17), as will hereinafter become apparent.

Referring now to FIG. 10, prior to movement into fusing relation with mold 44 the pin 70 is heated to a temperature sufficient to cause melting of the synthetic material of the fibers. Where that material is for example nylon, a temperature of approximately 600 F. is presently contemplated. The pin is then moved into fully seated position in mold cavity 46—determined for example by abutment of pin platform face 78 with mold surface 63—as illustrated in FIG. 11. At some point before the attainment of full seating of pin 70 in cavity 46, and preferably immediately before insertion of the pin into the mold, the heating of the pin is discontinued to enable suitably gradual cooling of the pin 70 while disposed in the mold cavity.

When first moved into fully inserted position in the mold cavity, the temperature of pin 70 is sufficient to cause substantially immediate fusing of the adjacent synthetic material. As a consequence, the interior faces of the brush head sections 28, 30, 26 are fused to their final shapes by the base 74, step 76 and upper portion of shaft 72, respectively, the brush rim 20 is formed against pin platform face 78, and the remainder of shaft 72 forms the brush membrane 34 from the adjacent fibers disposed in the base section 50 of the mold. At this point, it should be noted, the bottom or free end 38 of the distribution channel 32 defined by membrane 34 is closed.

The dwell time of pin 70—i.e. the time that the preheated pin remains within cavity 46 before its withdrawal therefrom—is preferably less than the period during which heater block 64 is held in heat transfer relation with mold 44, assuming that block 64 and pin 70 are heated to substantially the same temperature for fusing of the synthetic material. In the present instance and herein disclosed embodiment, a pin dwell time of approximately 1 to 5 seconds is preferred. Indeed, more important than the dwell time of the pin is the combination of the initial pin temperature on insertion into the mold cavity and of the rate of cooling of the pin, since it is generally intended that pin 70—and particularly that portion of shaft 72 that forms the distribution channel membrane 34—remain at a temperature sufficient to fuse the synthetic material for only a relatively brief interval before cooling to a temperature below the melting point of the material. This assures that, as is most preferred, the membrane 34 so formed is relatively thin, for example with respect to the brush wall 18, and therefore sufficiently flexible to prevent damage to the workpiece or discomfort to the user should the brush be pressed with undue force against the surface to which fluid is being applied. In addition, the cooling of the pin 70 below the melting point of the synthetic material of the brush prior to withdrawal of the pin from the mold cavity 46 assures that the fused synthetic material in immediate abutment with the pin will not stick or adhere to the pin as it is retracted from the mold. Those skilled in the art will understand and appreciate that the rate of cooling of pin 70 may be appreciably increased by circulating a cooling fluid through its interior or in any other suitable manner known in the art, thereby enabling the use of higher initial fusing temperatures and substantially shorter dwell times.

Figure 13:
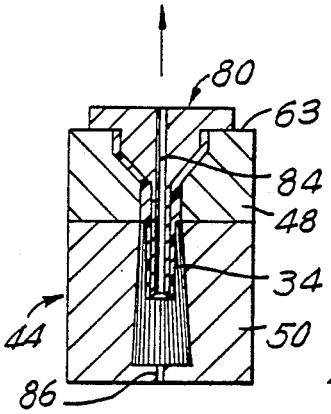
Figure 14:
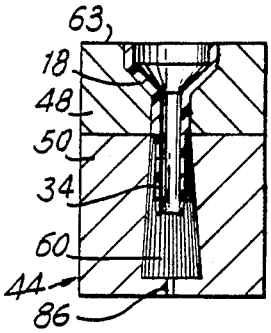

Following the formation of membrane 34 and retraction of pin 70 from the mold, a punch 80 is reciprocated into the mold cavity whereby the sharpened tip 82 of the punch cuts the discharge outlet or opening 36 in the free end of the distribution channel membrane (FIGS. 12 and 13). The opening 36 is preferably substantially centered at the bottom of the fluid distribution channel 32 and such centering may be facilitated by suitable configuration of the pin shaft 72 to provide an inward taper at the membrane end 38 to be cut by the punch; that taper, combined with the preferred flexibility of the membrane 34, enables substantial self-centering of the punch as it contacts and cuts through the membrane to form the opening 36.

Punch 80 may advantageously be provided with a throughpassage 84 terminating at the sharpened tip 82. A piston may be driven or a gaseous fluid such as air may be directed through passage 84 and outwardly through the tip end of the punch for displacing any loose fibers, as well as the portion of membrane 34 cut out by punch 80, from the brush interior while the punch remains within cavity 46. Mold 44 may correspondingly be provided, for example, with a vent aperture 86 or the like in its base section 50 through which such debris is dischargeable by the piston or gas stream or is otherwise removable from within the mold cavity.

Figure 15:
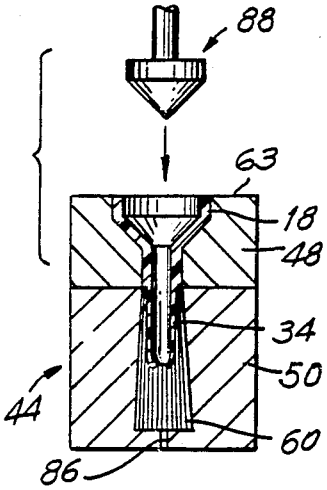
Figure 16:
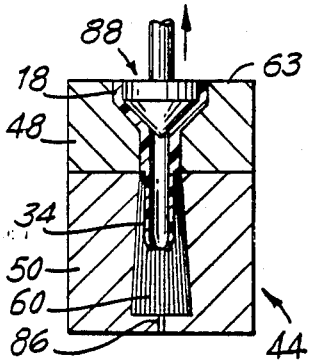
Figure 17:
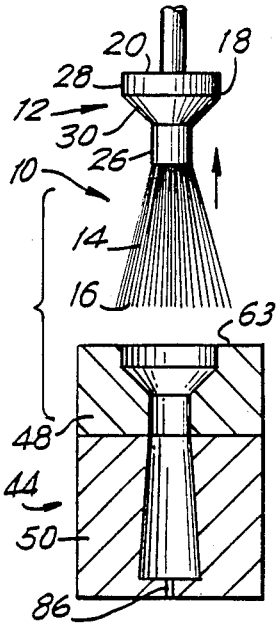

With the punch 80 thereafter withdrawn from the mold (FIG. 14), fabrication of the brush 10 is substantially complete. The completed brush may be removed from the mold cavity in any convenient manner, an example of which is depicted in FIGS. 15 to 17. As there shown, a rubber or similarly flexibly resilient pick-up member 88 is moved into the interior of the brush head section 12 to form an interference or press fit with the interior of peripheral wall 18. When the member 88 is thereafter retracted from the mold, it carries with it the brush 18 which may then, for example, be mounted to a fluid dispenser or the like and/or, if desired, subjected to buffing or other finishing steps which form no part of the present invention.

While there have thus been shown and described and pointed out fundamental novel features of the invention as applied to preferred embodiments thereof, it will be understood that various omissions and substitutions and changes in the form and details of the device illustrated and in its operation, and in the disclosed method, may be made by those skilled in the art without departing from the spirit of the invention. It is the intention, therefore, to be limited only as indicated by the scope of the claims appended hereto.

What is claimed is:

1. A method of making a brush adapted for applying a flowable fluid to a workpiece, comprising the steps of:

assembling a plurality of elongated filaments formed of a heat-fusible synthetic material into a tuft of said filaments;

securing together the proximal ends of the filaments in said tuft so as to define a brush head at the proximal end of the tuft; and heating a peripherally-interior portion of said tuft so as to form a substantially flexible membrane extending within and substantially axially along the tuft from said head toward the distal end of the tuft and thereby define a fluid distribution channel in said brush for feeding fluid through said brush from the head to the filaments proximate the filament distal ends for selective application of the fluid to a workpiece.

2. A method of making a brush in accordance with claim 1, further comprising defining an opening in the distribution channel membrane at the distal end of the distribution channel and through which fluid is feedable from the distribution channel onto the filaments proximate the filament distal ends for selective application to a workpiece.

3. A method of making a brush in accordance with claim 2, wherein said opening defining step comprises inserting a punch substantially axially into the distribution channel to create the opening at the distal end of the distribution channel.

4. A method of making a brush in accordance with claim 3, wherein said opening defining step comprises inserting the punch through the brush head.

5. A method of making a brush in accordance with claim 1, wherein said membrane forming heating step comprises inserting a heatable die substantially axially into the interior of the tuft through said brush head, and heating said heatable die to define the distribution channel.

6. A method of making a brush in accordance with claim 5, wherein said membrane forming step further comprises:

permitting the die to at least partly cool from its heated condition while the die remains inserted in the tuft interior; and withdrawing the at lest partly cooled die from the tuft interior.

7. A method of making a brush in accordance with claim 6, further comprising defining an opening in the distribution channel membrane at the distal end of the distribution channel and through which fluid is feedable from the distribution channel onto the filaments proximate the filament distal ends for selective application to a workpiece.

8. A method of making a brush in accordance with claim 7, wherein said opening defining step comprises inserting a punch substantially axially into the distribution channel to create the opening at the distal end of the distribution channel.

9. A method of making a brush in accordance with claim 8, wherein said opening defining step comprises inserting the punch through the brush head.

10. A method of making a brush in accordance with claim 5, wherein said membrane forming step further comprises:

heating the die to a filament fusing temperature prior to its insertion into the tuft interior;

discontinuing said heating of the die at least as early as its insertion into the tuft interior so that the die cools from said filament fusing temperature while it is in the tuft interior; and withdrawing the die from the tuft interior when the die has cooled to at least a predetermined temperature less than said filament fusing temperature.

11. A method of making a brush in accordance with claim 10, wherein said filament fusing temperature is approximately 600 degrees F.

12. A method of making a brush in accordance with claim 1, wherein the synthetic material is nylon.

13. A method of making a brush in accordance with claim 1, wherein the synthetic material is a polymer.

14. A method of making a brush in accordance with claim 1, wherein said assembling step comprises placing the plural filaments into a holder having a heatable die portion at a proximal end of the holder and a filament-receiving cavity extending into the holder from its proximal end.

* * * * *